US010503103B2

(12) United States Patent
Ogura

(10) Patent No.: US 10,503,103 B2
(45) Date of Patent: Dec. 10, 2019

(54) IMAGE HEATING APPARATUS AND IMAGE FORMING APPARATUS

(71) Applicant: CANON KABUSHIKI KAISHA, Tokyo (JP)

(72) Inventor: Ryota Ogura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/657,591

(22) Filed: Jul. 24, 2017

(65) Prior Publication Data

US 2018/0032009 A1 Feb. 1, 2018

(30) Foreign Application Priority Data

Jul. 28, 2016 (JP) ..... 2016-148387

(51) Int. Cl.
*G03G 15/20* (2006.01)
*H05B 3/00* (2006.01)
*H05B 1/02* (2006.01)

(52) U.S. Cl.
CPC ..... *G03G 15/2039* (2013.01); *G03G 15/2014* (2013.01); *G03G 15/2025* (2013.01); *G03G 15/2028* (2013.01); *G03G 15/2042* (2013.01); *G03G 15/2053* (2013.01); *H05B 1/0241* (2013.01); *H05B 3/0095* (2013.01); *G03G 15/206* (2013.01); *G03G 2215/2019* (2013.01); *G03G 2215/2035* (2013.01)

(58) Field of Classification Search
CPC ..... G03G 15/2039; G03G 15/2014; G03G 15/2053; G03G 15/2028; G03G 15/2075; G03G 15/2089; H05B 3/0095
See application file for complete search history.

(56) References Cited

U.S. PATENT DOCUMENTS 7,471,911 B2 12/2008 Ide et al.
2003/0198481 A1* 10/2003 Kikuchi ..... G03G 15/2042 399/69
2004/0141038 A1* 7/2004 Takagi ..... G03G 15/2053 347/102

(Continued)

FOREIGN PATENT DOCUMENTS

JP 2006-343690 A 12/2006
JP 2007-047390 A 2/2007
JP 5241144 B2 7/2013

*Primary Examiner* — Ryan D Walsh
(74) *Attorney, Agent, or Firm* — Venable LLP

(57) ABSTRACT

An image heating apparatus includes an image heating portion including first, second, and third heat generating blocks divided in a direction orthogonal to a conveying direction of the recording material. The image heating apparatus also includes a first driving circuit, a second driving circuit, a first temperature detection member, and a second temperature detection member. A control portion controls the first and second driving circuits according to at least one of the temperatures detected by the first and second temperature detection members, and controls energization of the second heat generating block together with a heat generating block that is energized by a driving circuit connected to the second heat generating block. In addition, a connection switching portion selectively connects any one of the first and second driving circuits to the second heat generating block according to a switching instruction from the control portion.

27 Claims, 8 Drawing Sheets

(56) References Cited

U.S. PATENT DOCUMENTS

| | | | | |
|---|---|---|---|---|
| 2005/0117923 | A1* | 6/2005 | Sasamoto | G03G 15/2039 399/45 |
| 2006/0222379 | A1* | 10/2006 | Nakazawa | G03G 15/80 399/12 |
| 2014/0072320 | A1* | 3/2014 | Ueno | G03G 15/2039 399/67 |
| 2014/0076878 | A1* | 3/2014 | Shimura | G03G 15/2042 219/216 |
| 2015/0010319 | A1* | 1/2015 | Akaishi | G03G 15/80 399/88 |
| 2015/0177655 | A1* | 6/2015 | Yamaguchi | G03G 15/2057 399/329 |
| 2016/0274510 | A1* | 9/2016 | Hase | G03G 15/2042 |
| 2017/0075266 | A1* | 3/2017 | Mochizuki | G03G 15/2039 |
| 2017/0075267 | A1* | 3/2017 | Yoshimura | G03G 15/2039 |
| 2017/0075268 | A1* | 3/2017 | Ogura | G03G 15/2053 |
| 2017/0075269 | A1* | 3/2017 | Iwasaki | G03G 15/2053 |
| 2017/0102650 | A1* | 4/2017 | Shimura | G03G 15/2053 |
| 2017/0364002 | A1* | 12/2017 | Ando | G03G 15/2053 |
| 2018/0004134 | A1* | 1/2018 | Nomura | G03G 15/2039 |
| 2018/0004136 | A1* | 1/2018 | Iwasaki | G03G 13/20 |
| 2018/0032008 | A1* | 2/2018 | Sako | G03G 15/80 |
| 2018/0067428 | A1* | 3/2018 | Takagi | G03G 15/2053 |

* cited by examiner

| STATE | RECORDING SHEET WIDTH | RLON456 | CONTACT |
|---|---|---|---|
| STATE I | DL ENVELOPE | High | NO |
| | COM10 ENVELOPE | High | NO |
| STATE II | A5 | Low | NC |
| STATE III | Letter | High | NO |
| | Legal | High | NO |
| | A4 | High | NO |

| STATE | RECORDING SHEET WIDTH | RELAY 701 | | RELAY 702 | |
|---|---|---|---|---|---|
| | | RLON701 | CONTACT | RLON702 | CONTACT |
| STATE I | DL ENVELOPE | High | NO | High | NO |
| | COM10 ENVELOPE | High | NO | High | NO |
| STATE II | A5 | High | NO | Low | NC |
| STATE IV | Executive | Low | NC | Low | NC |
| | B5 | Low | NC | Low | NC |
| STATE III | Letter | Low | NC | High | NO |
| | Legal | Low | NC | High | NO |
| | A4 | Low | NC | High | NO |

IMAGE HEATING APPARATUS AND IMAGE FORMING APPARATUS

This application claims the benefit of Japanese Patent Application No. 2016-148387, filed on Jul. 28, 2016, which is hereby incorporated by reference herein in its entirety.

BACKGROUND OF THE INVENTION

Field of the Invention

The present invention relates to an image forming apparatus, such as a copying machine or a printer, that uses an electrophotographic system or an electrostatic recording system. The present invention also relates to an image heating apparatus, such as a fixing unit, mounted on an image forming apparatus, and a gloss applying apparatus that heats the toner image fixed on a recording material again (i.e., a second time) in order to improve the gloss level of the toner image.

Description of the Related Art

An image forming apparatus that uses an electrophotographic system, an electrostatic recording system, or the like, is provided with an image heating apparatus serving as a fixing unit to heat and to fix a toner image formed on a recording material. An example of such an image heating apparatus is an apparatus that includes a fixing film (also referred to as an endless belt), a heater that makes contact with an inner surface of the fixing film, and a roller that forms a nip portion together with the heater, with the fixing film interposed therebetween. When printing is performed continuously on small-size sheets using an image forming apparatus having such an image heating apparatus, a phenomenon that the temperature of a region in which a sheet does not pass in a longitudinal direction of the nip portion increases gradually (a temperature rise in a non-sheet-passing portion) may occur. When the temperature of the non-sheet-passing portion is too high, parts of the image forming apparatus may be damaged. Japanese Patent No. 5241144 discloses one method for suppressing a temperature rise in the non-sheet-passing portion. According to Japanese Patent No. 5241144, two conductors are arranged along a longitudinal direction, a heat generating element is disposed between the conductors, and at least one of the two conductors is a heater that is divided into small blocks having widths corresponding to sheet sizes, so that heating is controlled for respective small blocks.

In the heater in which heating is performed in respective blocks, however, it has been known that it is necessary to provide a temperature detection member in each block for the purpose of regulating a temperature in each block and monitoring abnormal temperature. On the other hand, it is necessary to decrease the number of temperature detection members in order to suppress an increase in size of such an image forming apparatus.

SUMMARY OF THE INVENTION

An object of the present invention is to provide a technique capable of securing safety of an image forming apparatus in the event of an abnormal operation without arranging a temperature detection member in each heat generating block.

According to one aspect, the present invention provides there is provided an image heating apparatus including an image heating portion that heats an image formed on a recording material, the image heating portion including a plurality of heat generating blocks, the plurality of heat generating blocks including a first heat generating block, a second heat generating block, and a third heat generating block divided in a direction orthogonal to a conveying direction of the recording material, a first driving circuit that energizes the first heat generating block, a second driving circuit that energizes the third heat generating block, a first temperature detection member that detects a temperature of the first heat generating block, a second temperature detection member that detects a temperature of the third heat generating block, and a control portion that controls the first and second driving circuits according to at least one of the temperatures detected by the first and second temperature detection members, wherein the apparatus comprises a connection switching portion that selectively connects any one of the first and second driving circuits to the second heat generating block according to a switching instruction from the control portion, and wherein the control portion controls energization of the second heat generating block together with a heat generating block that is energized by the driving circuit connected to the second heat generating block.

In another aspect, the present invention provides an image forming apparatus including an image forming portion that forms an image on a recording material, and a fixing portion that fixes the image formed on the recording material to the recording material, wherein the fixing portion is the image heating apparatus.

According to the present invention, it is possible to secure safety of an image forming apparatus in the event of an abnormal operation without arranging a temperature detection member in each heat generating block.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. The sizes, materials, shapes, their relative arrangements, or the like, of constituents described in the embodiments may, however, be appropriately changed according to the configurations, various conditions, or the like, of apparatuses to which the invention is applied.

Therefore, the sizes, the materials, the shapes, their relative arrangements, or the like, of the constituents described in the embodiments do not limit the scope of the invention to the following embodiments.

Embodiment 1

Figure 1:
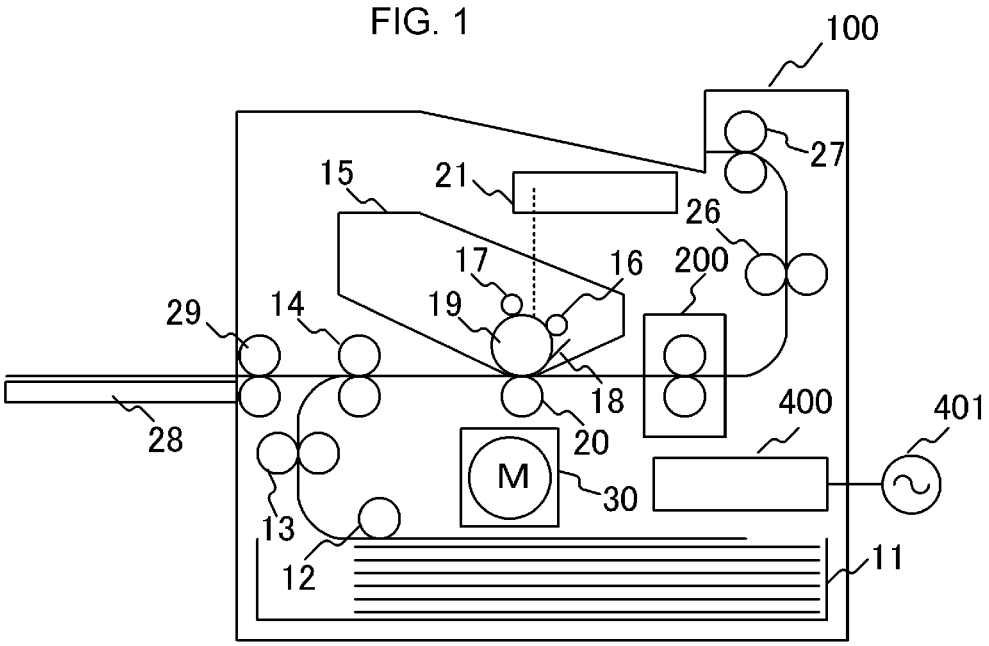
FIG. 1 is a cross-sectional view of an image forming apparatus according to Embodiment 1.

FIG. 1 is a schematic cross-sectional view of an image forming apparatus (hereinafter referred to as a laser printer) 100 that uses an electrophotographic recording technique. Embodiments of an image forming apparatus 100 to which the present invention can be applied include a copying machine, a printer, and the like, that uses an electrophotographic system or an electrostatic recording system. In this example, a case in which the present invention is applied to a laser printer will be discussed.

When a print signal is generated, a scanner unit 21 emits a laser beam modulated according to image information to scan a photosensitive member 19 that is charged to a predetermined polarity by a charging roller 16. In this way, an electrostatic latent image is formed on the photosensitive member 19. Toner is supplied from a developing device 17 to the electrostatic latent image, and a toner image corresponding to the image information is formed on the photosensitive member 19. The photosensitive member 19, the charging roller 16, and the developing device 17 are integrated as a process cartridge 15 that includes a toner storage chamber, and are configured to be detachably attached to a main body of the laser printer 100. On the other hand, each recording sheet P, as a recording material stacked on a sheet feed cassette 11 is fed by a pickup roller 12, one by one, and is conveyed toward a registration roller 14 by a roller 13. Furthermore, each recording sheet P is conveyed from the registration roller 14 to a transfer position in synchronization with a timing at which the toner image on the photosensitive member 19 reaches the transfer position formed by the photosensitive member 19 and the transfer roller 20. The toner image on the photosensitive member 19 is transferred to the recording sheet P in the course in which the recording sheet P passes the transfer position. After that, the recording sheet P is heated by a fixing apparatus 200 that is an image heating apparatus, as a fixing portion of an image forming apparatus 100, and the toner image is heated and fixed to the recording sheet P. The recording sheet P that bears the toner image fixed thereto is discharged to a tray in an upper part of the laser printer 100 by rollers 26 and 27. Reference numeral 18 is a cleaner that cleans the photosensitive member 19, and reference numeral 28 is a sheet feed tray (a manual tray) having a pair of recording sheet regulating plates, the width of which can be adjusted according to the size of the recording sheet P. The sheet feed tray 28 is provided so as to support a recording sheet P having a size other than standard sizes. Reference numeral 29 is a pickup roller that feeds the recording sheet P from the sheet feed tray 28, and reference numeral 30 is a motor that drives the fixing apparatus 200 and the like. Electrical power is supplied from a control circuit 400, connected to a commercial alternating-current power supply 401, to the fixing apparatus 200. The photosensitive member 19, the charging roller 16, the scanner unit 21, the developing device 17, and the transfer roller 20 form an image forming portion that forms a non-fixed image on the recording sheet P.

The laser printer 100 of this embodiment may be used to print on a plurality of recording sheet sizes. Letter sheet (approximately 216 mm×279 mm), Legal sheet (approximately 216 mm×356 mm), A4 sheet (210 mm×297 mm), and Executive sheet (approximately 184 mm×267 mm) can be set on the sheet feed cassette 11. Furthermore, JIS B5 sheet (182 mm×257 mm) and A5 sheet (148 mm×210 mm) can be also set. Moreover, non-standard sheets, including a DL envelope (110 mm×220 mm) and a COM10 envelope (approximately 105 mm×241 mm), can be fed from the sheet feed tray 28 and printing can be performed thereon. The laser printer 100 of this example is a laser printer that basically feeds sheets vertically (that is, sheets are conveyed so that the long side is parallel to the conveying direction). A recording sheet P having the maximum width among the widths (the widths of recording sheets in a catalog) of the standard recording sheets P supported by the laser printer 100 is Letter sheet and Legal sheet that have a width of approximately 216 mm. A recording sheet P having a smaller sheet width than the maximum size supported by the laser printer 100 is defined as a small-size sheet in this embodiment.

Figure 2:
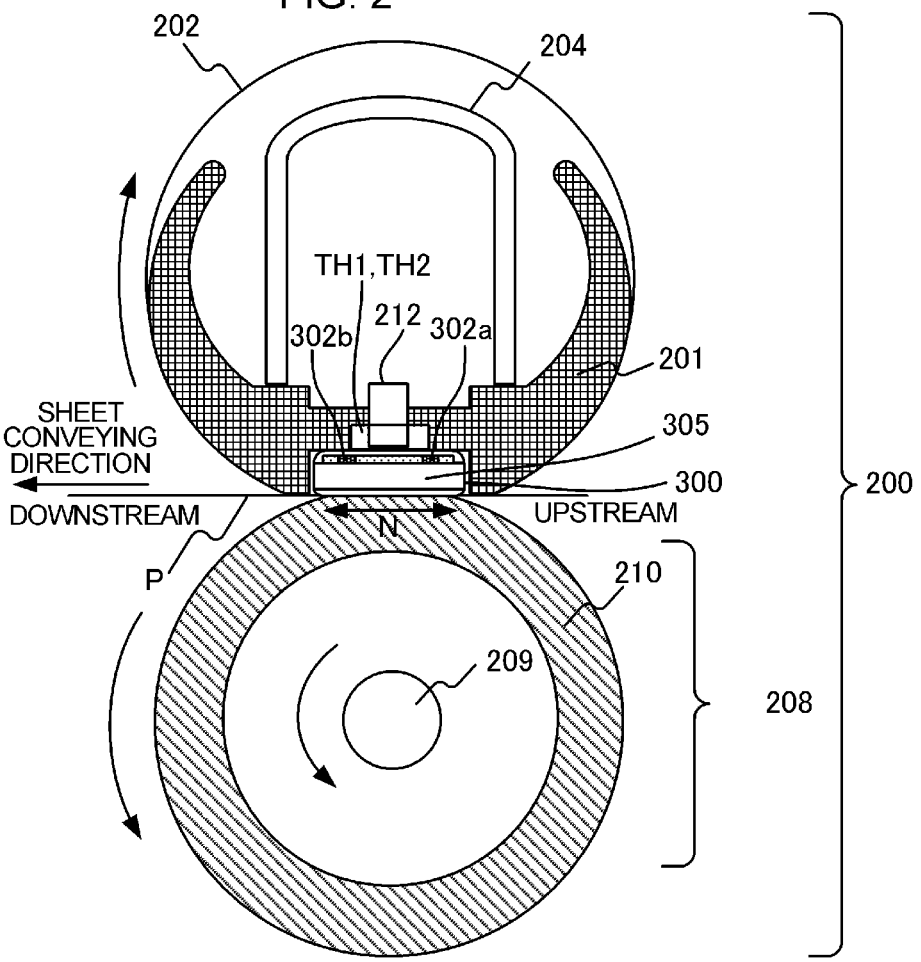
FIG. 2 is a cross-sectional view of a fixing apparatus according to Embodiment 1.

FIG. 2 is a schematic cross-sectional view of the fixing apparatus 200. The fixing apparatus 200 includes a fixing film (hereinafter referred to as a film) 202 that is a tubular film, a heater 300 that makes contact with an inner surface of the film 202, and a pressure roller 208 that forms a fixing nip portion N together with the heater 300, with the film 202 interposed therebetween. The constituent elements, such as the fixing film 202, the heater 300, and the pressure roller 208, associated with heating of an image formed on these recording materials, correspond to an image heating portion of the present invention. The material of a base layer of the film 202 is a heat-resistant resin, such as polyimide, or a metal, such as stainless steel. Moreover, an elastic layer, such as heat-resistant rubber, may be formed on a surface layer of the film 202. The pressure roller 208 has a core 209 formed of iron, aluminum, or the like, and an elastic layer 210 formed of silicon rubber, or the like. The heater 300 is held by a holding member 201 formed of a heat-resistant resin. The holding member 201 has a guide function of guiding rotation of the film 202. Reference numeral 204 is a metallic stay for applying pressure of a spring (not illustrated) to the holding member 201. The pressure roller 208 rotates in the direction indicated by an arrow in response to motive power from the motor 30. The film 202 rotates following the rotation of the pressure roller 208. The recording sheet P that bears a non-fixed toner image is heated and fixed using the heat of the heater 300 while being conveyed in a state of being pinched by the fixing nip portion N.

The heater 300 is heated by heat generating resistors (heat generating elements) 302*a* and 302*b* provided on a ceramic substrate 305 to be described later. Thermistors TH1 and TH2 (first and second temperature detection members) as an example of a temperature detection portion are in contact with a sheet-passing region of the laser printer 100 on a heat generating resistor side of the substrate 305. Similarly, a safety element 212, such as a thermo switch or a temperature fuse, that operates in the event of abnormal heating of the heater 300 to interrupt electrical power supplied to the heater 300, is also in contact with the sheet-passing region.

Figure 3A:
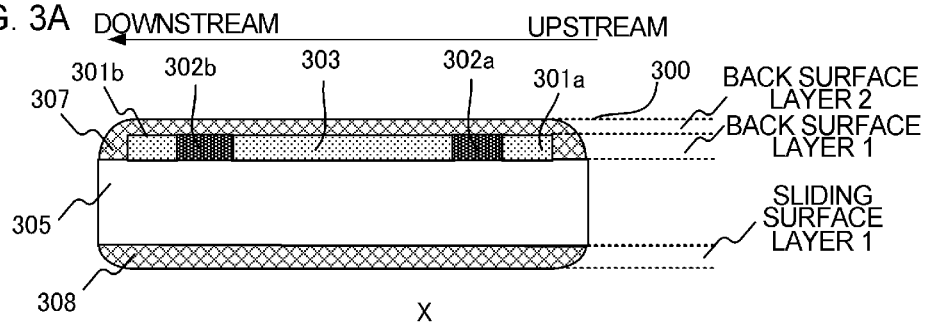
FIGS. 3A to 3C are diagrams illustrating a configuration of a heater according to Embodiment 1.

FIG. 3A illustrates a schematic cross-sectional view in a transverse direction (a direction orthogonal to the longitudinal direction) of the heater 300. The heater 300 includes a conductor 303 provided on the substrate 305 along the longitudinal direction of the heater 300, and conductors 301*a* and 301*b* provided on the substrate 305 at a position different from the conductor 303 in the transverse direction of the heater 300 along the longitudinal direction of the heater 300. The conductor 301*a* is disposed on the upstream side in the conveying direction of the recording sheet P, and the conductor 301*b* is disposed on the downstream side (hereinafter, the conductors 301*a* and 301*b* will be collectively referred to as a conductor 301). Furthermore, the heater 300 includes heat generating resistors 302*a* and 302*b* provided between the conductors 301 and 303 to generate heat using the electrical power supplied via the conductors 301 and 303. The heat generating resistor 302*a* is disposed on the upstream side in the conveying direction of the recording sheet P, and the heat generating resistor 302*b* is disposed on the downstream side (hereinafter, the heat generating resistors 302*a* and 302*b* will be collectively referred to as a heat generating resistor 302).

When a heat distribution in the transverse direction (the conveying direction of the recording sheet P) of the heater 300 is asymmetrical, the stress occurring in the substrate 305 when the heater 300 generates heat increases. When the stress occurring in the substrate 305 increases, a crack may occur in the substrate 305. Due to this, the heat generating resistor 302 is divided into the heat generating resistor 302*a* disposed on the upstream side in the conveying direction and the heat generating resistor 302*b* disposed on the downstream side so that the heat distribution in the transverse direction of the heater 300 is symmetrical. The heat distribution is not limited, however, to a symmetrical distribution and the heat generating resistor 302 may not be divided into upstream and downstream sides.

A surface protection layer 307 having an insulating property (in this embodiment, formed of glass) that covers the heat generating resistor 302 and the conductors 301 and 303 is provided on a rear surface layer 2 of the heater 300. Moreover, a surface protection layer 308 that is a coating of glass or polyimide having a sliding property is formed on a sliding surface layer 1 (a surface that makes contact with the fixing film 202) of the heater 300.

Figure 3B:
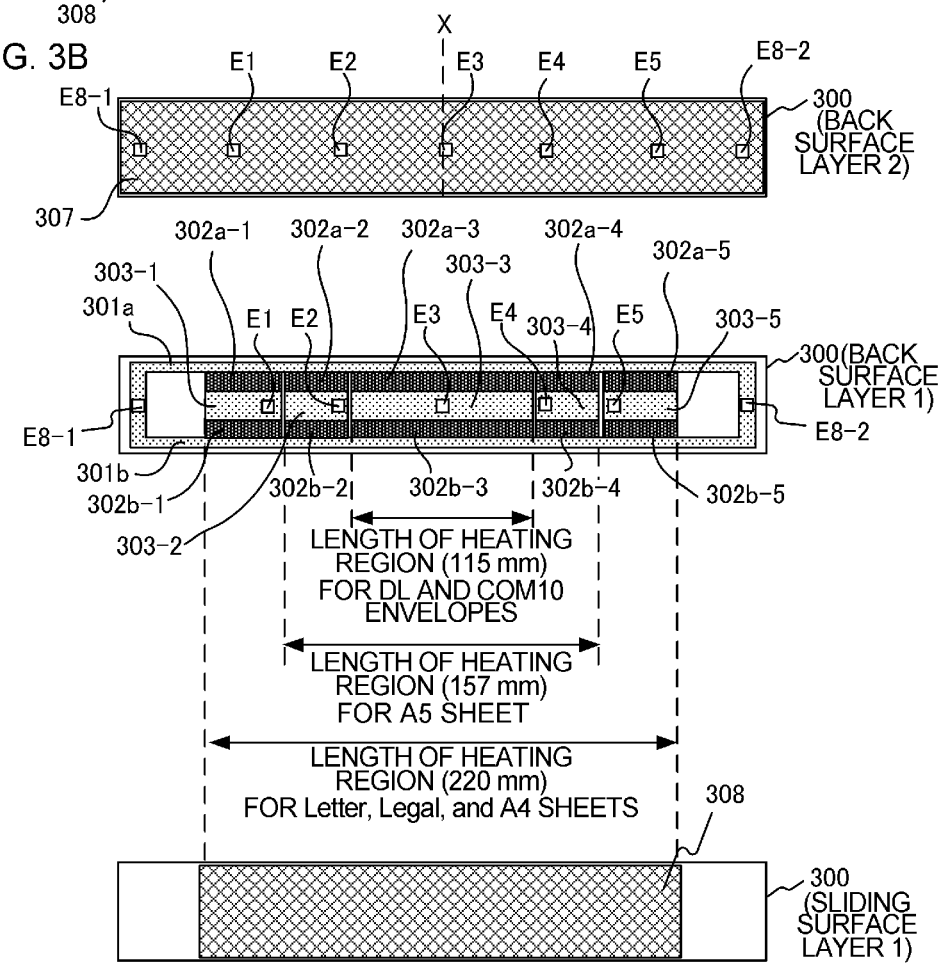

FIG. 3B illustrates a plan view of respective layers of the heater 300. A plurality of heat generating blocks each made up of a group including the conductors 301 and 303 and the heat generating resistor 302, is provided on the rear surface layer 1 of the heater 300 along the longitudinal direction of the heater 300. The heater 300 of this embodiment has five heat generating blocks in total at both ends and the center in the longitudinal direction of the heater 300. The five heat generating blocks are formed of heat generating resistors 302*a*-1 to 302*a*-5 and heat generating resistors 302*b*-1 to 302*b*-5, respectively, formed symmetrically in the transverse direction of the heater 300. Hereinafter, the heat generating resistors 302*a*-1 and 302*b*-1 will be collectively referred to as a heat generating block 302-1, and the same is true for heat generating blocks 302-2 to 302-5. Moreover, the conductor 303 is also divided into five conductors 303-1 to 303-5.

The dividing position is determined according to a conveying position of the recording sheet P. In the present embodiment, the recording sheet P is conveyed in the transverse direction of the heater 300 about a reference conveying position X. Due to this, the dividing position is divided symmetrically at a position corresponding to a sheet size about the reference conveying position X as a central axis. In this embodiment, a heat generating block 302-3 as a third heat generating block is used for fixing as a heat generating block for the DL and COM10 envelopes. Three blocks, in which heat generating blocks 302-2 and 302-4 as a second heat generating block are added to the heat generating block 302-3, are used for fixing as a heat generating block for A5 sheets. All heat generating blocks (five blocks), in which heat generating blocks 302-1 and 302-5 that are first heat generating blocks are added, are used for fixing as heat generating blocks for Letter, Legal, and A4 sheets. The number of divisions or dividing positions is not limited to five, however, as in this embodiment.

Electrodes E1 to E5 are electrodes used for supplying electrical power to the heat generating blocks 302-1 to 302-5 via the conductors 303-1 to 303-5, respectively. Electrodes E8-1 and E8-2 are electrodes used for connecting to a common electrical contact used for supplying electrical power to the five heat generating blocks 302-1 to 302-5 via the conductors 301*a* and 301*b*. Moreover, the surface protection layer 307 on the rear surface layer 2 of the heater 300 is formed in a region excluding the positions of the electrodes E1 to E5, E8-1, and E8-2, and is configured such that an electrical contact can be connected to each electrode E1 to E5, E8-1, and E8-2 from the rear surface side of the heater 300.

Figure 3C:
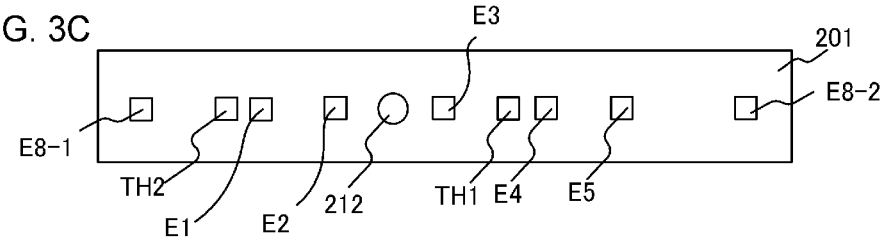

As illustrated in FIG. 3C, holes are formed in the holding member 201 of the heater 300 in order to create electrical contacts to the thermistors (temperature detection elements) TH1 and TH2, the safety element 212, and the electrodes E1 to E5, E8-1, and E8-2. Electrical contacts that make contact with the thermistors (temperature detection elements) TH1 and TH2, the safety element 212, and the electrodes E1 to E5, E8-1, and E8-2 are provided between the stay 204 and the holding member 201. In this embodiment, the thermistor TH1 is disposed at a position for detecting the temperature of the heat generating block 302-3 and the thermistor TH2 is disposed at a position for detecting the temperature of the heat generating block 302-1. Moreover, the electrical contacts that make contact with the electrodes E1 to E5, E8-1, and E8-2 are electrically connected to electrode portions of the heater 300 by a method such as spring-based biasing or welding. The respective electrical contacts are connected to a control circuit 400 (to be described later) of the heater 300 by a cable, provided between the stay 204 and the holding member 201, and a conductive material, such as a thin metal plate.

Figure 4:
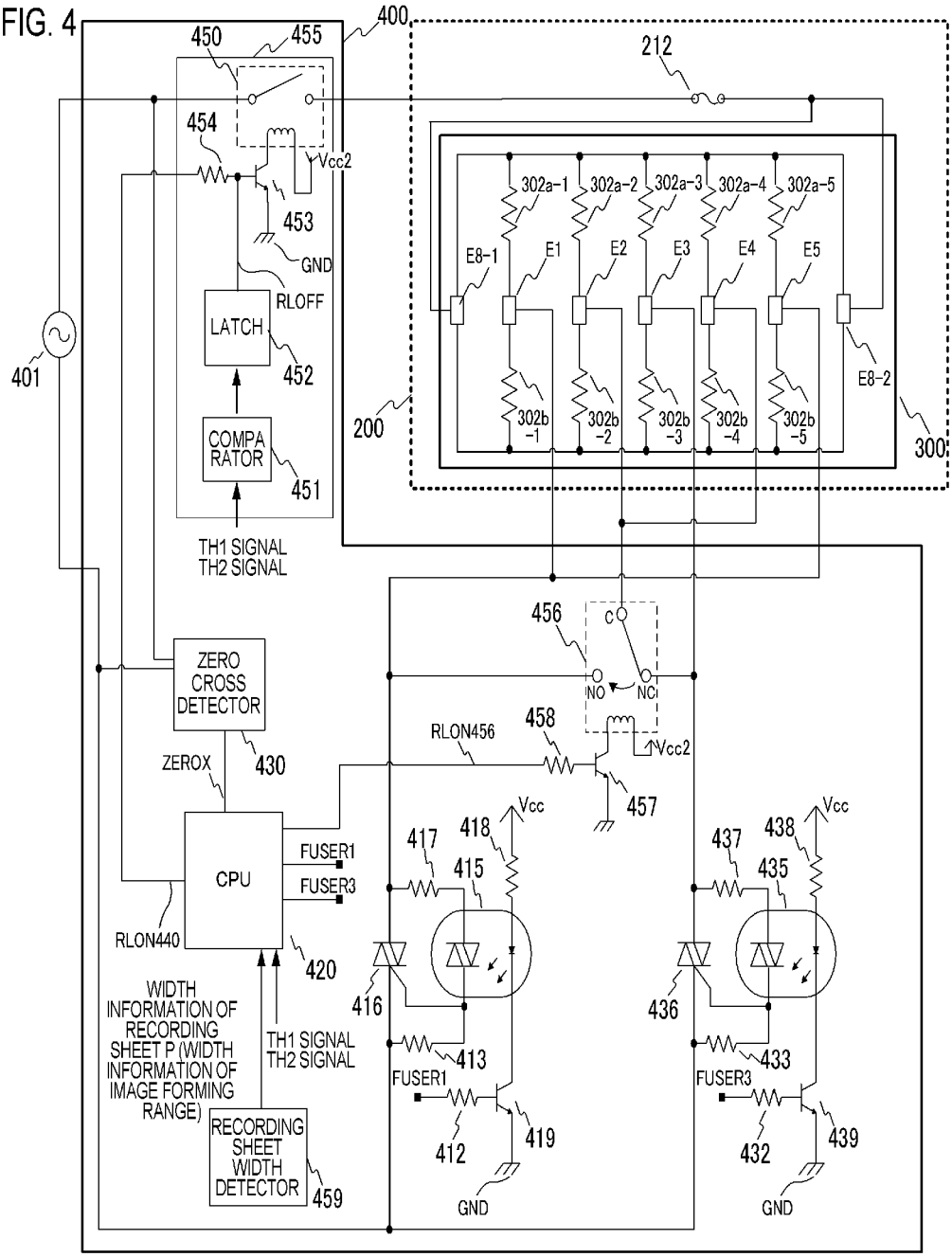
FIG. 4 is a diagram of a heater control circuit according to Embodiment 1.

FIG. 4 illustrates a circuit diagram of the control circuit 400 according to Embodiment 1. Reference numeral 401 is a commercial alternating-current power supply connected to the laser printer 100. The alternating-current power supply 401 is connected to the electrodes E8-1 and E8-2 of the heater 300 via a relay 450 and the safety element 212. The electrodes E1 to E5 are connected to a triac 416 that is a first driving circuit and that is a driving portion, and a triac 436 that is a second driving circuit, and heating of the heat generating resistor 302 is controlled by energization/de-energization.

Here, the operation of the triac 416 will be described. Resistors 413 and 417 are bias resistors for driving the triac 416, and a phototriac coupler 415 is a device for securing a creepage distance between a primary side and a secondary side. The triac 416 is turned on by energizing a light emitting diode of the phototriac coupler 415. A resistor 418 is a resistor for restricting a current flowing from a supply voltage node Vcc to the light emitting diode of the phototriac coupler 415. The phototriac coupler 415 is turned on/off by a transistor 419. The transistor 419 operates according to a signal FUSER1 from the CPU 420. The circuit operation of the triac 436 is the same as the triac 416, and the description thereof will not be provided. That is, the triac 436 is connected to resistors 433, 437, and 438, a phototriac coupler 435, and a transistor 439 and operates according to a signal FUSER3 from the CPU 420.

Next, a connection between the triacs 416 and 436 and the heater 300 will be described. The triac 416 is connected to the electrodes E1 and E5 to heat the heat generating blocks 302-1 and 302-5 located on the outermost sides in the longitudinal direction of the heater 300. The triac 436 is connected to the electrode E3 to heat the heat generating block 302-3 at the center in the longitudinal direction of the heater 300. Moreover, the heat generating blocks 302-2 and 302-4 are connected to a common terminal (a C-terminal) of a switching relay 456 that is a connection switching portion. The switching relay 456 is a transfer-type (c-contact-type) relay having such characteristics that either an NC terminal or an NO terminal is connected to the common terminal. The NC terminal is connected to the triac 436 and the NO terminal is connected to the triac 416. Therefore, the heat generating blocks 302-2 and 302-4 generate heat by the energization being controlled by any one of the triacs 416 and 436.

In this embodiment, although two electrodes E1 and E5 are connected to one triac, such as the triac 416, the present invention is not limited to this arrangement, and a separate triac may be connected to each of the electrodes E1 and E5. Moreover, the switching relay 456 is not limited to being disposed in the control circuit 400, and may be disposed in the fixing apparatus 200, for example.

The contact of the switching relay 456 is switched according to a signal RLON456 that is a switching instruction from a CPU 420 serving as a control portion. When the signal RLON456 changes to a High state, the transistor 457 enters into the ON state. Current flows from a supply voltage node Vcc2 to a secondary-side coil of the switching relay 456, and a primary-side contact of the switching relay 456 is switched from the NC terminal to the NO terminal. When the signal RLON456 changes to a Low state, the transistor 457 enters into the OFF state, the current flowing from the supply voltage node Vcc2 to the secondary-side coil of the switching relay 456 is blocked, and the primary-side contact of the switching relay 456 is switched to the NC terminal.

The relay 450 is used as a power interruption portion that interrupts the supply of electrical power to the heater 300 according to the output of the thermistors TH1 and TH2 when abnormal heating of the heater 300 occurs due to a failure, or the like. When a signal RLON440 changes to the High state, the transistor 453 enters into the ON state, a current flows from the supply voltage node Vcc2 to the secondary-side coil of the relay 450, and the primary-side contact of the relay 450 enters into the ON state. When the signal RLON440 changes to the Low state, the transistor 453 enters into the OFF state, the current flowing from the supply voltage node Vcc2 to the secondary-side coil of the relay 450 is blocked, and the primary-side contact of the relay 450 enters into a disconnected state.

Next, the operation of the safety circuit 455 that uses the relay 450 will be described. When any one of the temperatures detected by the thermistors TH1 and TH2 exceeds a predetermined value set thereto, a comparator 451 operates a latch 452 to latch the signal RLOFF to the Low state. When the signal RLOFF changes to the Low state, the relay 450 is maintained in the disconnected state since the transistor 453 is maintained in the OFF state even when the CPU 420 puts the signal RLON440 into the High state. When the temperatures detected by the thermistors TH1 and TH2 do not exceed the predetermined values set thereto, the signal RLOFF of the latch 452 enters into the open state. Due to this, when the CPU 420 puts the signal RLON440 into the High state, the relay 450 enters into an energized state and a state in which electrical power can be supplied to the heater 300 is created.

A zero cross detector 430 is a circuit that detects zero-cross of the alternating-current power supply 401 and outputs a signal ZEROX to the CPU 420. The signal ZEROX is used for controlling the heater 300. A recording sheet width detector 459 as a width detection portion is a sensor that detects the width of a sheet set on the sheet feed cassette 11.

Next, a temperature control method of the heater 300 will be described. The temperature of the heater 300 is detected by the thermistor TH1 and is input to the CPU 420 as a TH1 signal. The temperature of the thermistor TH2 is also detected by the CPU 420 by a similar method. As for internal processing of the CPU (control portion) 420, an amount of electrical power to be supplied is calculated, for example, by PI control, on the basis of the temperature detected by the thermistor TH1 and the temperature set to the heater 300. The electrical power is converted to a control level of a phase angle (phase control) or a wave number (wave number control) corresponding to the electrical power to be supplied, and the triacs 416 and 436 are controlled according to the control condition. In this embodiment, the temperature of the heater 300 is controlled on the basis of the heater temperature detected by the thermistor TH1. The temperature of the film 202 may be detected by a thermistor or a thermopile and the temperature of the heater 300 may be controlled on the basis of the detected temperature.

Figures 5A, 5B:
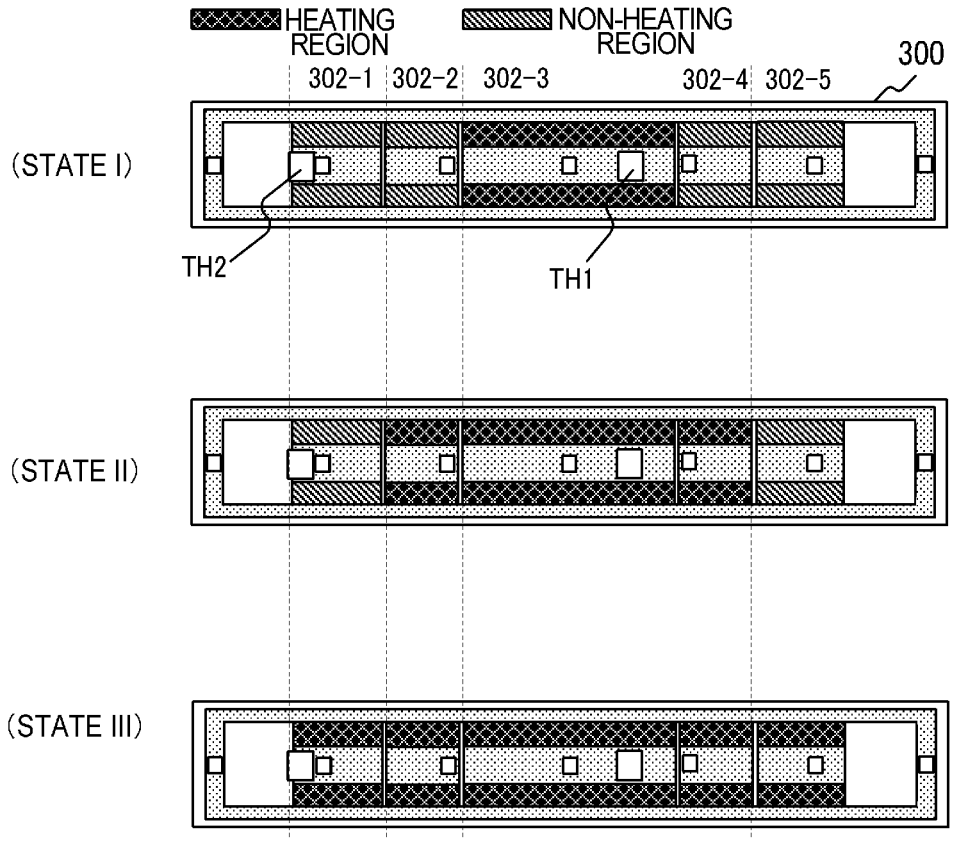
FIGS. 5A and 5B are diagrams illustrating the relationship between a recording sheet width and a heat generating region according to Embodiment 1.

FIGS. 5A and 5B are diagrams for describing the relationship between a recording sheet width and a switching state of the switching relay 456. FIG. 5A is a table that summarizes the correlation between a recording sheet width and a switching state of the switching relay 456, and FIG. 5B is a schematic plan view of a heater illustrating a heat generating region and a non-heat generating region in each state of FIG. 5A. When the size of a DL envelope or a COM10 envelope is detected by the recording sheet width detector 459 illustrated in FIG. 4, the CPU 420 puts the signal RLON456 into the High level and switches the connection of the switching relay 456 to the NO terminal. Therefore, the heat generating block 302-3, through which the recording sheet P passes, is heated by the triac 436 as indicated by state I.

Subsequently, when an A5 sheet is detected by the recording sheet width detector 459, the CPU 420 puts the signal RLON456 into the Low state and switches the connection of the switching relay 456 to the NC terminal. Therefore, the heat generating blocks 302-3, 302-2, and 302-4, through which the recording sheet P passes, are heated by the triac 436 as indicated by state II.

Subsequently, when a Letter sheet, a Legal sheet, or an A4 sheet is detected by the recording sheet width detector 459, since it is necessary to heat all heat generating blocks 302-1 to 302-5 as indicated by state III, both triacs 416 and 436 are driven. In this case, the connection of the switching relay 456 may be switched to any one of the NC terminal and the NO terminal, and, in this embodiment, the signal RLON456 is put into the High level so that the switching relay 456 is connected to the NO terminal.

In this manner, by switching the connection of the switching relay 456 according to the width of the detected recording sheet P, it is possible to control turning on/off of the necessary heat generating region. Moreover, since the heat generating block connected to the common terminal of the switching relay 456 is disposed between heat generating blocks that are adjacent to each other on the heater 300, it is possible to perform switching control so that the heating width of the entire heat generating resistor 302 can be varied.

Next, safety protection according to this embodiment will be described with reference to FIG. 4 and FIGS. 5A and 5B. The thermistor TH2 adjacent to the heat generating block 302-1 that is energized by the triac 416 is provided so that, when the triacs 416 and 436 are energized continuously due to a failure, or the like, of the control circuit 400, the state thereof can be detected (FIG. 5B). Moreover, the thermistor TH1 adjacent to the heat generating block 302-3 that is energized by the triac 436 is provided. Due to such a configuration, when abnormal heating occurs in a heat generating block, the safety circuit 455 is operated to prevent destruction of components of the fixing apparatus 200. Moreover, the heat generating blocks 302-2 and 302-4 are selectively connected to the triac 416 or 436 by the switching relay 456. Due to this, when the heat generating blocks 302-2 and 302-4 are heated continuously, the heat generating blocks 302-1 and 302-3, the temperature of which is monitored by the thermistors TH1 and TH2, are also heated simultaneously.

For example, when the triac 416 is energized continuously and the switching relay 456 is connected to the NO terminal, the heat generating blocks 302-2 and 302-4 and the heat generating blocks 302-1 and 302-5 are continuously heated simultaneously. Therefore, abnormal heating is detected by the thermistor TH2 provided on the heat generating block 302-1 and the safety circuit 455 is operated. In this manner, even when the switching relay 456 is switched to any side, heat generating blocks monitored by any one of the thermistors TH1 and TH2 are heated simultaneously. Due to this, it is possible to secure safety without providing a thermistor in the heat generating blocks 302-2 and 302-4 connected to the common terminal of the switching relay 456.

As described above, a thermistor is disposed in a heat generating block connected directly to a triac, and electrical power is supplied from the triac to a heat generating block connected via a switching relay. In this way, it is possible to secure safety even when a thermistor for a heat generating block connected via a switching relay is not provided. Moreover, since a heat generating block connected via a switching relay is disposed between heat generating blocks connected directly to a triac, it is possible to control a heat generating region by switching the switching relay.

Embodiment 2

Embodiment 2 of the present invention will be described. In Embodiment 2, the number of divisions and dividing positions of the heat generating resistor 302 of the heater 300 described in Embodiment 1 is changed. The same constituent elements as those of Embodiment 1 will be denoted by the same reference numerals and the description thereof will not be provided.

Figure 6A:
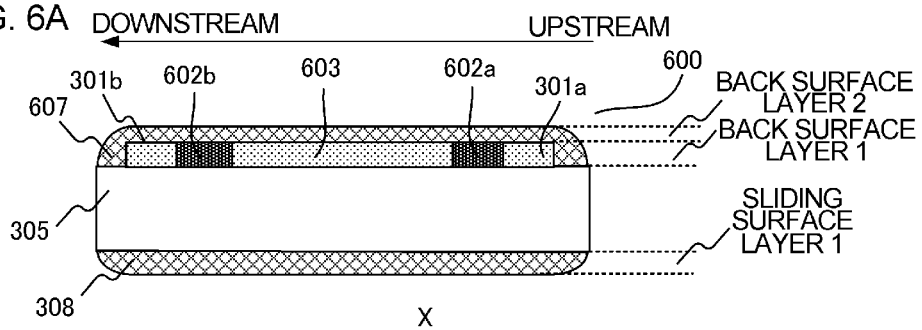
FIGS. 6A to 6C are diagrams illustrating a configuration of a heater according to Embodiment 2.

FIG. 6A illustrates a cross-sectional view in a transverse direction of a heater 600. The number of divisions is seven, and is greater than the number of divisions of the heater 300 of Embodiment 1. The heater 600 includes heat generating resistors 602*a* and 602*b* that are provided between conductors 301 and 603 to generate heat according to an electrical power supplied via the conductors 301 and 603. The heat generating resistor 602*a* is disposed on the upstream side in the conveying direction of the recording sheet P, and the heat generating resistor 602*b* is disposed on the downstream side. Hereinafter, the heat generating resistors 602*a* and 602*b* will be collectively referred to as a heat generating resistor 602. Moreover, a surface protection layer 607 having an insulating property (in this embodiment, formed of glass) that covers the heat generating resistor 602 and the conductors 301 and 603 is provided on a rear surface layer 2 of the heater 600.

Figure 6B:
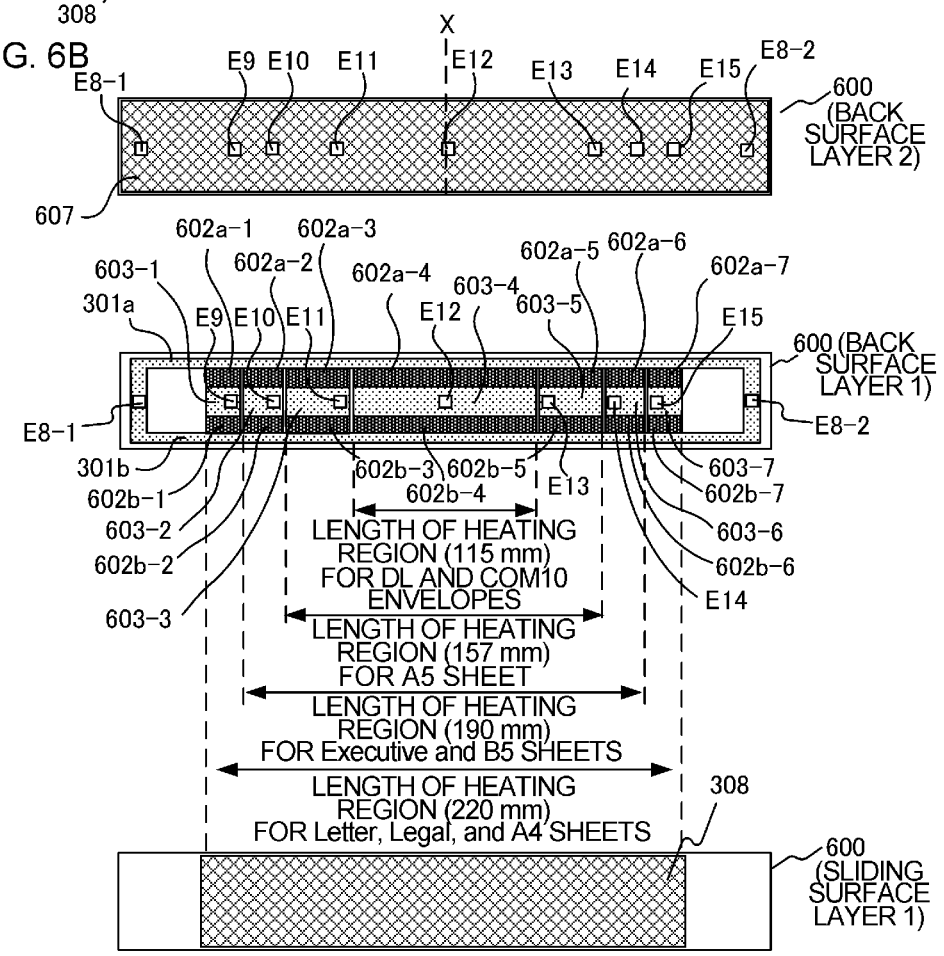

FIG. 6B illustrates a plan view of respective layers of the heater 600. A plurality of heat generating blocks, each made up of a group including the conductors 301 and 603 and the heat generating resistor 602, is provided on the rear surface layer 1 of the heater 600 along the longitudinal direction of the heater 600. The heater 600 of this embodiment has seven heat generating blocks in total at both ends and the center in the longitudinal direction of the heater 600. The seven heat generating blocks are formed of heat generating resistors 602*a*-1 to 602*a*-7 and heat generating resistors 602*b*-1 to 602*b*-7, respectively, that are formed symmetrically in the transverse direction of the heater 600. Hereinafter, the heat generating resistors 602*a*-1 and 602*b*-1 will be collectively referred to as a heat generating block 602-1, and the same is true for the heat generating blocks 602-2 to 602-7. Moreover, the conductor 603 is also divided into seven conductors 603-1 to 603-7.

In this embodiment, heat generating blocks for Executive and B5 sheets are added to the heat generating blocks corresponding to the recording sheet size of Embodiment 1. Therefore, the heat generating block 602-4 is used for fixing as a heat generating block for DL and COM10 envelopes, and the heat generating blocks 602-3 to 602-5 are used for fixing as a heat generating block for the A5 sheet. The heat generating blocks 602-2 to 602-6 are used for fixing as a heat generating block for Executive and B5 sheets. All heat generating blocks (seven blocks) 602-1 to 602-7 are used for fixing as heat generating blocks for Letter, Legal, and A4 sheets. The number of divisions or dividing positions is not limited, however, to seven as in this embodiment.

Electrodes E9 to E15 and conductors 603-1 to 603-7 are provided to correspond to seven divisions in order to supply electrical power to the heat generating blocks 602-1 to 602-7. Moreover, the surface protection layer 607 of the rear surface layer 2 of the heater 600 is formed in a region excluding the positions of the electrodes E9 to E15, E8-1, and E8-2 and is configured such that an electrical contact can be connected to each electrode from the rear surface side of the heater 600.

Figure 6C:
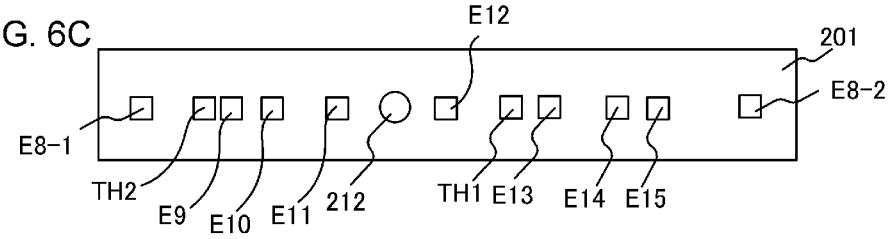

As illustrated in FIG. 6C, holes are formed in the holding member 201 of the heater 600 in order to create electrical contacts to the thermistors TH1 and TH2, as examples of temperature detection members, the safety element 212, and the electrodes E9 to E15, E8-1, and E8-2. In this embodiment, the thermistor TH1 is disposed at a position for detecting the temperature of the heat generating block 602-4, and the thermistor TH2 is disposed at a position for detecting the temperature of the heat generating block 602-1. Moreover, the electrical contacts that make contact with the electrodes E9 to E15, E8-1, and E8-2 are electrically connected to electrode portions of the heater 600 by a method such as spring-based biasing or welding. The respective electrical contacts are connected to a control circuit 700 (to be described later) of the heater 600 by a cable, provided between the stay 204 and the holding member 201, and a conductive material, such as a thin metal plate.

Figure 7:
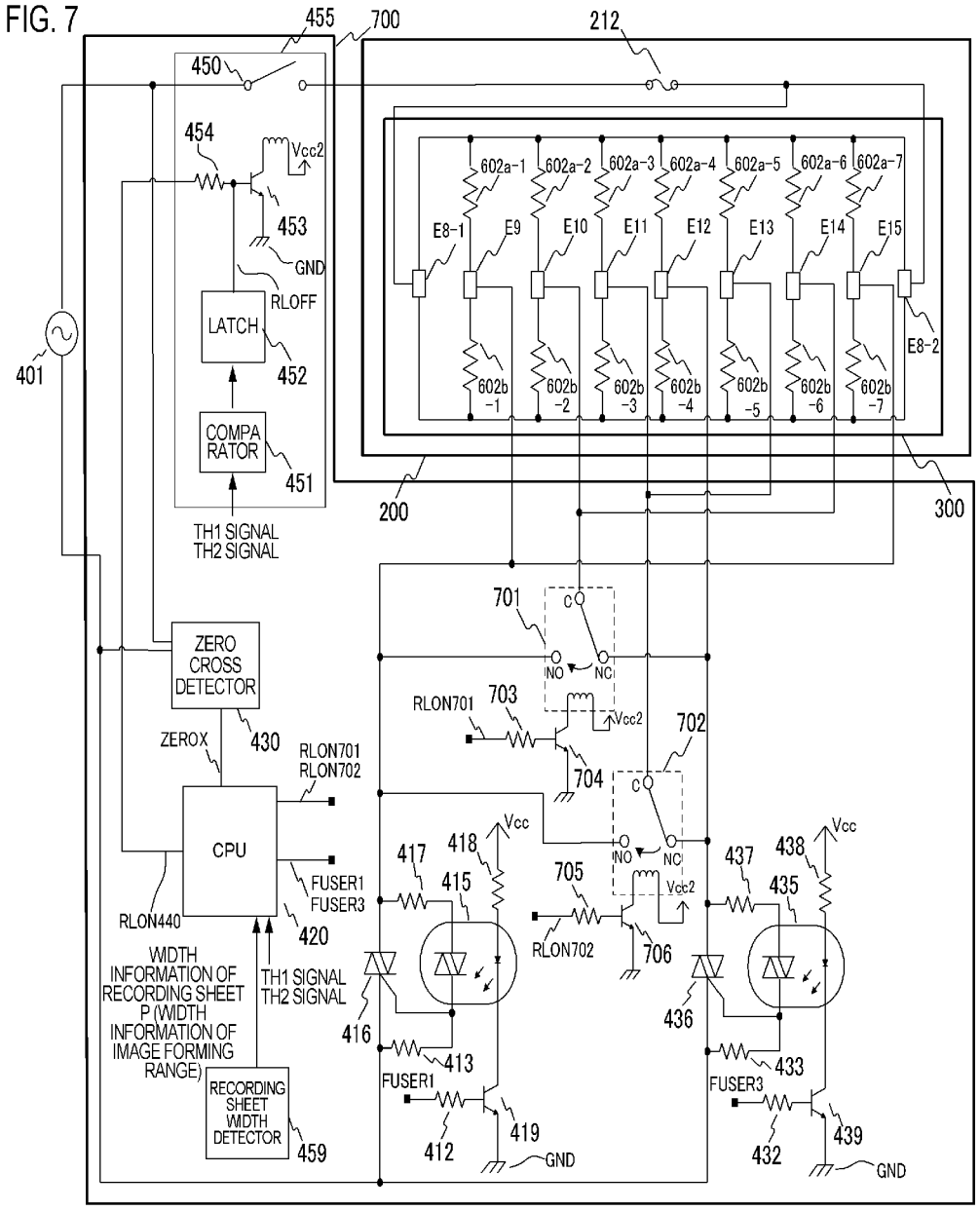
FIG. 7 is a diagram illustrating a heater control circuit according to Embodiment 2.

FIG. 7 illustrates a circuit diagram of the control circuit 700 according to Embodiment 2. The alternating-current power supply 401, the relay 450, the safety element 212, the triacs 416 and 436 that are the first and second driving circuits, the zero cross detector 430, the CPU 420, the safety circuit 455, and the recording sheet width detector 459 are the same as those of Embodiment 1, and the description thereof will not be provided.

Next, connection between the triacs 416 and 436 and the heater 600 will be described. The triac 416 is connected to the electrodes E9 and E15 to heat the heat generating blocks 602-1 and 602-7 on the outermost sides in the longitudinal direction of the heater 600. The triac 436 is connected to the electrode E12 to heat the heat generating block 602-4 at the center in the longitudinal direction of the heater 600. Moreover, the heat generating blocks 602-2 and 602-6 are connected to a common terminal (a C-terminal) of a switching relay 701. Furthermore, the heat generating blocks 602-3 and 602-5 are connected to a common terminal (the C-terminal) of the switching relay 702. The switching relays 701 and 702 are transfer-type (c-contact-type) relays having such characteristics that any one of the NC terminal and the NO terminal is connected to the common terminal similarly to the switching relay 456 described in Embodiment 1. The NC terminal of the switching relay 701 is connected to the triac 436 and the NO terminal is connected to the triac 416. Moreover, the NC terminal of the switching relay 702 is connected to the triac 436 and the NO terminal is connected to the triac 416. Therefore, energization of the heat generating blocks 602-2 to 602-6 is controlled by any one of the triacs 416 and 436.

In this embodiment, although two electrodes E9 and E15 are connected to one triac like the triac 416, the present invention is not limited to this arrangement, and a separate triac may be connected to each of the electrodes E9 and E15. Moreover, the switching relays 701 and 702 are not limited to being disposed in the control circuit 400, and may be disposed in the fixing apparatus 200, for example.

The contacts of the switching relays 701 and 702 are switched according to signals RLON701 and RLON702 from the CPU 420 that is a control portion. When the signals change to the High state, transistors 704 and 706 enter into the ON state, current flows from the supply voltage node Vcc2 to the secondary-side coils of the switching relays 701 and 702, and the primary-side contacts of the switching relays 701 and 702 are switched from the NC terminal to the NO terminal. When the signals RLON701 and RLON702 change to the Low state, the transistors 704 and 706 enter into the OFF state, and the current flowing from the supply voltage node Vcc2 to the secondary-side coils of the switching relays 701 and 702 is blocked. Moreover, the primary-side contacts of the switching relays 701 and 702 are switched to the NC terminal.

Figures 8A, 8B:
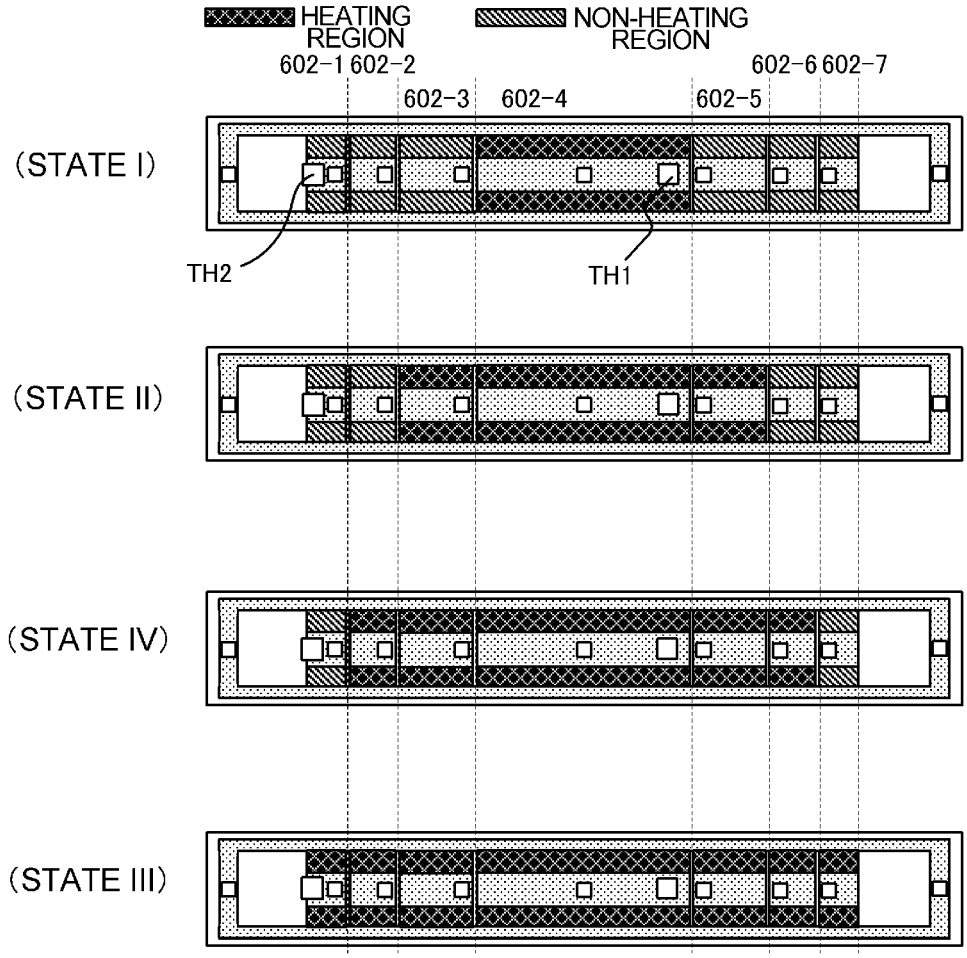
FIGS. 8A and 8B are diagrams illustrating the relationship between a recording sheet width and a heat generating region according to Embodiment 2.

FIGS. 8A and 8B are diagrams for describing the relationship between a recording sheet width and the switching state of the switching relays 701 and 702. FIG. 8A is a table that summarizes the correlation between a recording sheet width and a switching state of the switching relays 701 and 702, and FIG. 8B is a schematic plan view of a heater illustrating a heat generating region and a non-heat generating region in each state of FIG. 8A. When the size of a DL envelope or a COM10 envelope is detected by the recording sheet width detector 459, the CPU 420 puts the signal RLON701 to the High level and switches the connection of the switching relay 701 to the NO terminal. Moreover, the signal RLON702 is put into the High level and the connection of the switching relay 702 is put into the NO terminal. Therefore, the heat generating block 602-4, through which the recording sheet P passes, is heated by the triac 436 as indicated by state I.

Subsequently, when an A5 sheet is detected by the recording sheet width detector 459, the CPU 420 puts the signal RLON701 into the High level and switches the connection of the switching relay 701 to the NO terminal. Moreover, the signal RLON702 is put into the Low level and the connection of the switching relay 702 is switched to the NC terminal. Therefore, the heat generating blocks 602-3 to 602-5, through which the recording sheet P passes, are heated by the triac 436 as indicated by state II.

Subsequently, when an Executive sheet or a B5 sheet is detected by the recording sheet width detector 459, the CPU 420 puts the signal RLON701 into the Low level and switches the connection of the switching relay 701 to the NC terminal. Moreover, the signal RLON702 is put into the Low level and the connection of the switching relay 702 is switched to the NC terminal. Therefore, the heat generating blocks 602-2 to 602-6, through which the recording sheet P passes, are heated by the triac 436 as indicated by state IV.

Subsequently, when a Letter sheet, a Legal sheet, or an A4 sheet is detected by the recording sheet width detector 459, since it is necessary to heat all heat generating blocks 602-1 to 602-7 as indicated by state III, both triacs 416 and 436 are driven. In this case, the connection of the switching relays 701 and 702 may be switched to either the NC terminal or the NO terminal. In this embodiment, the signal RLON701 is put into the Low level so that the switching relay 701 is connected to the NC terminal, and the signal RLON702 is put into the High level so that the switching relay 702 is connected to the NO terminal.

In this manner, by switching the connection of the switching relays 701 and 702 according to the width of the recording sheet P, it is possible to control turning on/off of the necessary heat generating region. Moreover, since the heat generating block connected to the common terminals of the switching relays 701 and 702 is disposed between heat generating blocks that are adjacent to each other on the heater 600, it is possible to perform switching control so that the heating width of the entire heat generating resistor 602 can be varied.

Next, safety protection according to this embodiment will be described with reference to FIG. 7 and FIGS. 8A and 8B. The thermistor TH2 adjacent to the heat generating block 602-1 that is energized by the triac 416 is provided so that, when the triacs 416 and 436 are energized continuously due to a failure, or the like, of the control circuit 700, the state thereof can be detected (FIG. 8B). Moreover, the thermistor TH1 adjacent to the heat generating block 602-4 that is energized by the triac 436 is provided. The safety circuit 455 is operated by the thermistors TH1 and TH2 to prevent destruction of components of the fixing apparatus 200. Moreover, the heat generating blocks 602-2 and 602-6 are selectively connected to the triac 416 or 436 by the switching relay 701. The heat generating blocks 602-3 and 602-5 are connected to the triac 416 or 436 by the switching relay 702. Due to this, when the heat generating blocks 602-2, 602-3, 602-5, and 602-6 are heated continuously, the heat generating blocks 602-1 and 602-4, the temperature of which is monitored by the thermistors TH1 and TH2, are also heated simultaneously.

For example, when the triac 416 is energized continuously, the switching relay 701 is connected to the NO terminal, and the switching relay 702 is also connected to the NO terminal, the heat generating blocks 602-1 to 602-3 and the heat generating blocks 602-5 to 602-7 are continuously heated simultaneously. Therefore, the safety circuit 455 is operated by the thermistor TH2 provided on the heat generating block 602-1. In this manner, even when the switching relays 701 and 702 are switched to any side, heat generating blocks monitored by the thermistors are heated simultaneously. Therefore, it is possible to secure safety without providing a thermistor in the heat generating blocks 602-2 and 602-6 and the heat generating blocks 602-3 and 602-5 connected to the common terminals of the switching relays 701 and 702.

As described above, even when the number of divisions of the heat generating resistor is increased, a thermistor may be disposed in a heat generating block connected directly to a triac, and electrical power may be supplied from the triac to a heat generating block connected via a switching relay. Due to such a configuration, it is possible to secure safety even when a thermistor for a heat generating block connected via a switching relay is not provided. Moreover, since a heat generating block connected via a switching relay is disposed between heat generating blocks connected directly to a triac, it is possible to control a heat generating region by switching the switching relay.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

an image heating portion that heats an image formed on a recording material, the image heating portion including a plurality of heat generating blocks, the plurality of heat generating blocks including a first heat generating block, a second heat generating block, and a third heat generating block divided in a direction orthogonal to a conveying direction of the recording material;

a first driving circuit that energizes the first heat generating block;

a second driving circuit that energizes the third heat generating block;

a first temperature detection member that detects a temperature of the first heat generating block;

a second temperature detection member that detects a temperature of the third heat generating block;

a control portion that controls the first driving circuit and the second driving circuit according to at least one of the temperatures detected by the first temperature detection member and the second temperature detection member, and that controls energization of the second heat generating block together with a heat generating block that is energized by a driving circuit connected to the second heat generating block; and a connection switching portion that selectively connects any one of the first driving circuit and the second driving circuit to the second heat generating block according to a switching instruction from the control portion.

2. The image heating apparatus according to claim 1, wherein the connection switching portion is a transfer-type switching relay.

3. The image heating apparatus according to claim 1, further comprising a width detection portion that detects a width of the recording material, wherein the connection switching portion switches the driving circuit to be connected to the second heat generating block according to the width of the recording material detected by the width detection portion.

4. The image heating apparatus according to claim 1, wherein the second heat generating block is disposed between the first heat generating block and the third heat generating block in the direction orthogonal to the conveying direction.

5. The image heating apparatus according to claim 1, wherein the image heating portion further includes:

a tubular film; and a heater that includes a substrate, and a plurality of heat generating elements provided on the substrate, the heater making contact with an inner surface of the film, and the image heating portion heating the image formed on the recording material using heat generated by the heater.

6. The image heating apparatus according to claim 5, wherein the heating portion further includes a roller for forming a nip portion with the heater through the film, and wherein the recording material is conveyed by rotation of the roller at the nip portion, and the image formed on the recording material is heated at the nip portion.

7. An image forming apparatus comprising:

an image forming portion that forms an image on a recording material; and a fixing portion that fixes the image formed on the recording material to the recording material, wherein the fixing portion is the image heating apparatus according to claim 1.

8. The image heating apparatus according to claim 1, wherein the apparatus does not include a temperature detection member that detects a temperature of the second heat generating block.

9. The image heating apparatus according to claim 1, further comprising a relay provided in a power supply path between a commercial alternating-current power supply, the first driving circuit, and the second driving circuit, the relay being configured to open when the temperature detected by at least one of the first temperature detection member and the second temperature detection member reaches a threshold value.

10. The image heating apparatus according to claim 1, wherein each of the first driving circuit and the second driving circuit includes a triode for alternating current (TRIAC) for controlling electrical power.

11. An image heating apparatus comprising:

a heater configured to heat an image formed on a recording material, the heater including a first heat generating block, a second heat generating block, and a third heat generating block divided in a direction orthogonal to a conveying direction of the recording material;

a first driving element provided in a first power supply path to the first heat generating block;

a second driving element provided in a second power supply path to the third heat generating block; and a relay configured to switch between a connected state, in which the second heat generating block and the first driving element are connected, and a disconnected state, in which the second heat generating block and the first driving element are disconnected, the relay being provided in a third power supply path that is branched from the first power supply path and that extends toward the second heat generating block.

12. The image heating apparatus according to claim 11, further comprising:

a number of temperature detection elements that detect a temperature of the second heat generating block; and a number of temperature detection elements that detect a temperature of the first heat generating block, the number of temperature detection elements that detect the temperature of the second heat generating block being fewer than the number of temperature detection elements that detect the temperature of the first heat generating block.

13. The image heating apparatus according to claim 11, further comprising a temperature detection element that detects a temperature of the first heat generating block, wherein a temperature detection element that detects a temperature of the second heat generating block is not provided.

14. The image heating apparatus according to claim 11, wherein the relay is a transfer-type switching relay having a common terminal, a normally-closed (NC) terminal, and a normally-open (NO) terminal, and wherein the second heat generating block is connected to the common terminal of the transfer-type switching relay, one of the first heat generating block and the third heat generating block is connected to the NC terminal of the transfer-type switching relay, and the other one of the first heat generating block and the third heat generating block is connected to the NO terminal of the transfer-type switching relay.

15. The image heating apparatus according to claim 11, wherein the relay is a transfer-type switching relay that switches according to the width of the recording material.

16. The image heating apparatus according to claim 11, wherein the second heat generating block is disposed between the first heat generating block and the third heat generating block in the direction orthogonal to the conveying direction.

17. The image heating apparatus according to claim 11, further comprising a tubular film, wherein the heater is in contact with an inner surface of the film.

18. The image heating apparatus according to claim 17, wherein the heater further includes a substrate, and the first heat generating block, the second heat generating block, and the third heat generating block are provided on the substrate.

19. The image heating apparatus according to claim 18, further comprising a roller for forming a nip portion with the heater through the film, wherein the recording material is conveyed by rotation of the roller at the nip portion, and the image formed on the recording material is heated at the nip portion.

20. The image heating apparatus according to claim 11, further comprising:

a second relay provided in a power supply path between a commercial alternating-current power supply and the first heat generating block; and a temperature detection member configured to detect a temperature of the first heat generating block, wherein the second relay is configured to open when the temperature detected by the temperature detection member reaches a threshold value.

21. The image heating apparatus according to claim 11, wherein each of the first driving element and the second driving element includes a triode for alternating current (TRIAC) for controlling electrical power.

22. An image forming apparatus comprising:

an image forming portion that forms an image on a recording material; and a fixing portion that fixes the image formed on the recording material to the recording material, wherein the fixing portion is the image heating apparatus according to claim 11.

23. An image heating apparatus comprising:

a heater configured to heat an image formed on a recording material, the heater including a first heat generating block and a second heat generating block divided in a direction orthogonal to a conveying direction of the recording material;

a first power supply path configured to connect a commercial power supply with the first heat generating block;

a second power supply path configured to connect the commercial power supply with the second heat generating block, the second power supply path being branched from the first power supply path at a branch point;

a first switch configured to change a connection state of the first power supply path, the first switch being provided in an area between the commercial power supply and the branch point in the first power supply path;

a second switch configured to change a connection state of the second power supply path, the second switch being provided in the second power supply path; and a temperature detection element that detects a temperature of the first heat generating block, wherein the image heating apparatus does not include a switch for changing the connection state of the first power supply path in an area between the branch point and the first heat generating block in the first power supply path, and wherein a temperature detection element that detects a temperature of the second heat generating block is not provided.

24. The image heating apparatus according to claim 23, further comprising a tubular film, wherein the heater is in contact with an inner surface of the film.

25. The image heating apparatus according to claim 24, wherein the heater further includes a substrate, and the first heat generating block and the second heat generating block are provided on the substrate.

26. The image heating apparatus according to claim 25, further comprising a roller for forming a nip portion with the heater through the film, wherein the recording material is conveyed by rotation of the roller at the nip portion, and the image formed on the recording material is heated at the nip portion.

27. An image forming apparatus comprising:

an image forming portion that forms an image on a recording material; and a fixing portion that fixes the image formed on the recording material to the recording material, wherein the fixing portion is the image heating apparatus according to claim 23.

* * * * *